US008538287B2

(12) United States Patent
Kawai

(10) Patent No.: US 8,538,287 B2
(45) **Date of Patent: *Sep. 17, 2013**

(54) CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

(75) Inventor: Takeshi Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 191 days.

This patent is subject to a terminal disclaimer.

(21) Appl. No.: 13/022,871

(22) Filed: Feb. 8, 2011

(65) Prior Publication Data

US 2012/0002998 A1 Jan. 5, 2012

(30) Foreign Application Priority Data

Jul. 1, 2010 (JP) ..... 2010-151376

(51) Int. Cl.
*G03G 15/02* (2006.01)

(52) U.S. Cl.
USPC ..... 399/100; 399/256

(58) Field of Classification Search
USPC ..... 399/100
See application file for complete search history.

(56) References Cited

U.S. PATENT DOCUMENTS

| | | | | |
|---|---|---|---|---|
| 8,320,790 | B2 * | 11/2012 | Yamaguchi | 399/99 |
| 2009/0220286 | A1 | 9/2009 | Kurihara | |
| 2011/0170901 | A1 * | 7/2011 | Kawai et al. | 399/100 |

FOREIGN PATENT DOCUMENTS

| | | |
|---|---|---|
| JP | U1-58-079764 | 5/1983 |
| JP | A-2-272594 | 11/1990 |
| JP | A-7-129055 | 5/1995 |
| JP | A-07-219313 | 8/1995 |
| JP | A-7-219313 | 8/1995 |
| JP | A-08-133545 | 5/1996 |
| JP | A-2001-209238 | 8/2001 |
| JP | A-2009-204917 | 9/2009 |

OTHER PUBLICATIONS

Feb. 26, 2013 Office Action issued in Japanese Application No. 2010-151376 (with translation).

* cited by examiner

*Primary Examiner* — David Gray
*Assistant Examiner* — Michael Harrison
(74) *Attorney, Agent, or Firm* — Oliff & Berridge, PLC

(57) ABSTRACT

A cleaning member for an image forming apparatus includes a core and an elastic layer that is formed by a strip-shaped elastic member helically wound around an outer peripheral surface of the core. The cleaning member satisfies the following formula (1):

$$0.7<t/T<1.0 \quad (1)$$

where t (mm) denotes a thickness of the elastic layer, the thickness being taken in a central portion in a helical width direction of the elastic layer, and T (mm) denotes a thickness of the central portion of the strip-shaped elastic member in a width direction before wound around the outer peripheral surface of the core.

11 Claims, 7 Drawing Sheets

CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-151376 filed Jul. 1, 2010.

BACKGROUND (i) Technical Field

The present invention relates to a cleaning member for an image forming apparatus, a charging device, a unit for an image forming apparatus, a process cartridge, and an image forming apparatus.

(ii) Related Art

According to an electrophotographic image forming apparatus, a surface of an image-carrying member including a photoconductor or the like is charged with a charging device to create charges and an electrostatic latent image is formed by, for example, a laser beam obtained by modulating an image signal. Then the electrostatic latent image is developed with charged toner to form a visible toner image. The toner image is electrostatically transferred onto a receiving member such as recording sheet either directly or via an intermediate transfer body and fixed onto a receiving member to obtain an image.

SUMMARY

According to an aspect of the invention, there is provided a cleaning member for an image forming apparatus, the cleaning member including a core and an elastic layer that is formed by a strip-shaped elastic member helically wound around an outer peripheral surface of the core. The cleaning member satisfies the following formula (1):

$$0.7<t/T<1.0 \quad (1)$$

where t (mm) denotes a thickness of the elastic layer, the thickness being taken in a central portion in a helical width direction of the elastic layer, and T (mm) denotes a thickness of the central portion of the strip-shaped elastic member in a width direction before wound around the outer peripheral surface of the core.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described. The components that have the same functions and effects are represented by the same reference symbols throughout the drawings and the descriptions therefore may be omitted to avoid redundancy.

(Cleaning Member)

Figure 1:
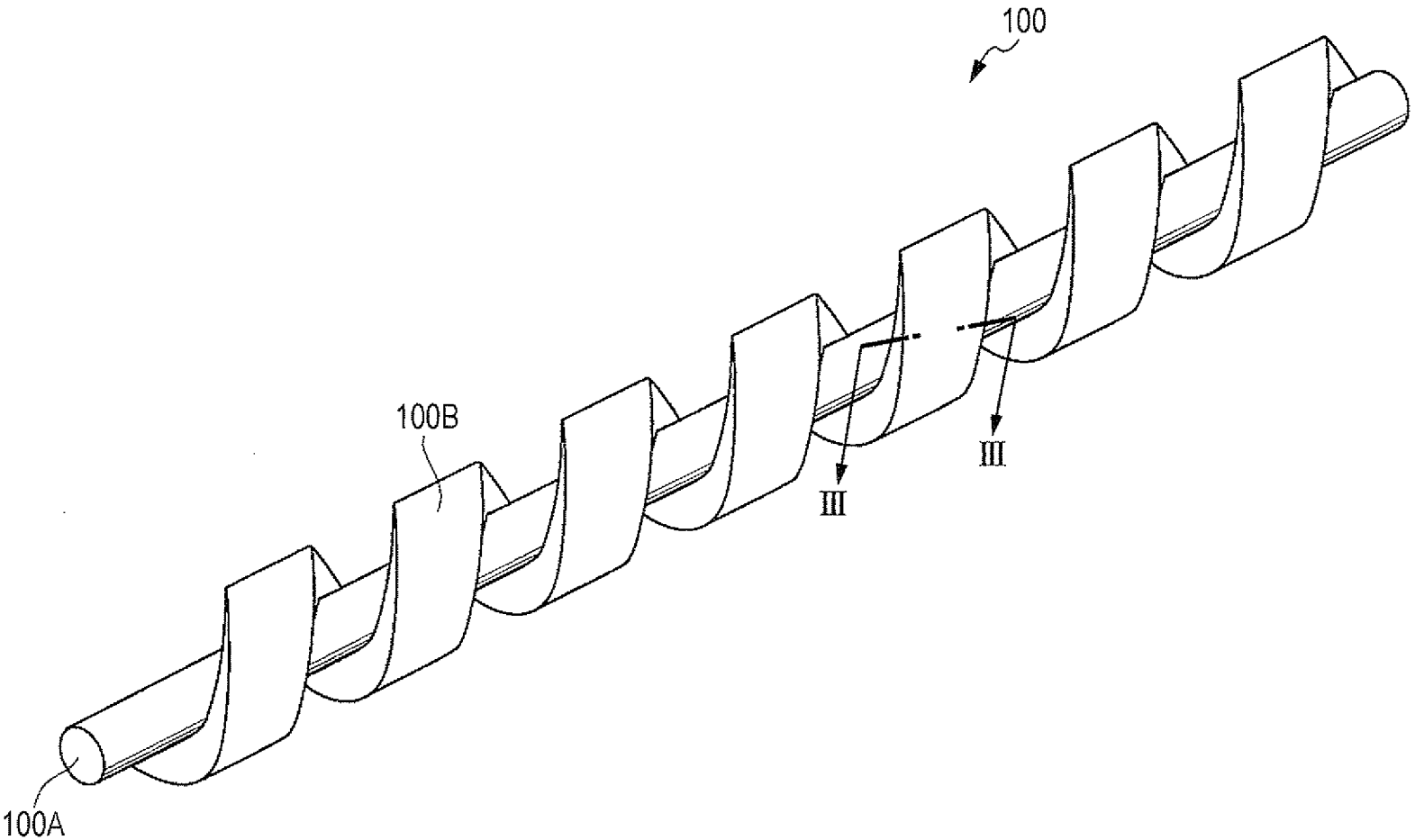
FIG. 1 is a schematic perspective view showing a cleaning member for an image forming apparatus according to an exemplary embodiment.
Figure 2:
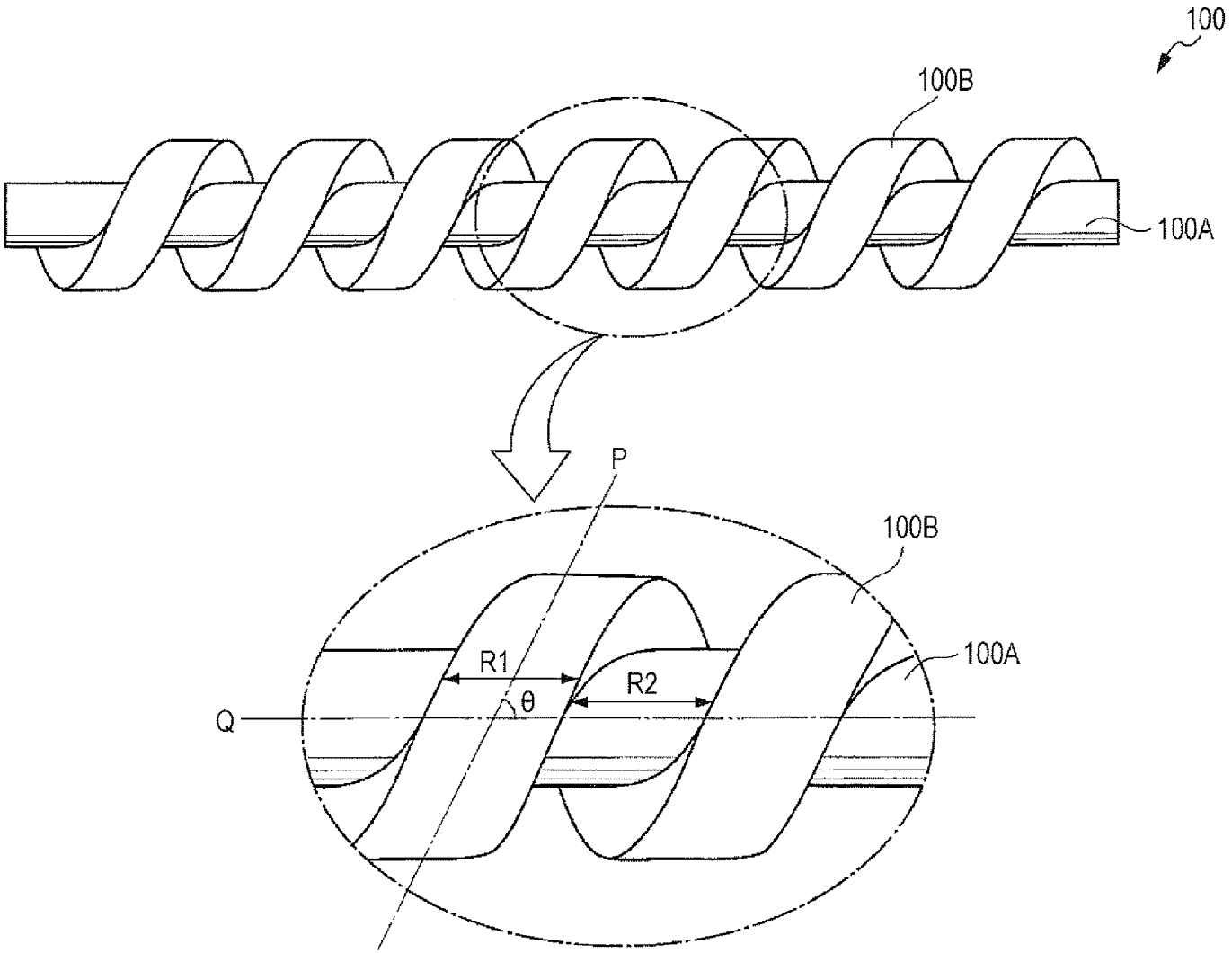
FIG. 2 is a schematic side view of the cleaning member for an image forming apparatus according to the exemplary embodiment.
Figure 3:
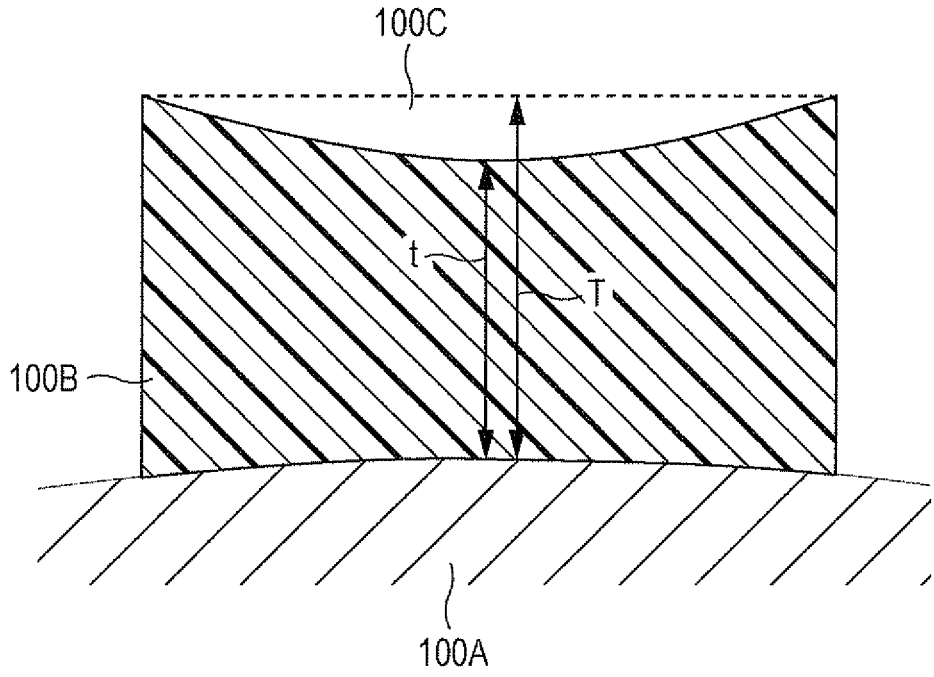
FIG. 3 is an enlarged cross-sectional view showing the thickness of an elastic layer of the cleaning member for an image forming apparatus according to the exemplary embodiment.

FIG. 1 is a schematic perspective view showing a cleaning member for an image forming apparatus according to an exemplary embodiment. FIG. 2 is a schematic side view of the cleaning member for an image forming apparatus according to the exemplary embodiment. FIG. 3 is an enlarged cross-sectional view showing the thickness of an elastic layer of the cleaning member and is taken along line III-III in FIG. 1, i.e., in a direction orthogonal to the helical direction of the elastic layer. The elastic layer includes all layers formed on the core.

As shown in FIGS. 1 to 3, a cleaning member 100 of an image forming apparatus (simply referred to as "cleaning member 100" hereinafter) according to this exemplary embodiment is a roll-shaped member that includes a core 100A and an elastic layer 100B. The elastic layer 100B is formed by helically winding a strip-shaped elastic member (referred to as "strip 100C" hereinafter) on the surface of the core 100A. In particular, the elastic layer 100B is formed by helically winding a strip 100C around the core 100A serving as a helical axis from one end to the other end of the core 100A at particular intervals.

The elastic layer 100B satisfies conditional formula (A1) below where t (mm) represents the thickness of the elastic layer 100B in the central portion in the helical width direction of the elastic layer formed on the outer peripheral surface of the core 100A and T (mm) represents the thickness of the strip 100C in the central portion in the strip width direction before wound around the outer peripheral surface of the core 100A (refer to FIG. 3):

$$0.7<t/T<1.0 \quad \text{Conditional formula A1}$$

According to the cleaning member 100 of this exemplary embodiment having such a structure, deformation of the elastic layer 100B after storage (in particular, storage in a high-temperature, high-humidity environment, e.g., in a 40° C. 95% RH environment) is suppressed. Although the reason is not clear, it is presumed as follows.

When an elastic layer 100B is disposed on the outer peripheral surface of the core 100A by winding a strip 100C around the core 100A, the strip 100C is wound around the outer peripheral surface of the core 100A while being imparted predetermined tension in the longitudinal direction (winding direction). Application of tension is required in order to wind the strip 100C around the core 100A. Accordingly, the elastic layer 100B wound around the core 100A is elastically deformed (in other words, the thickness of the elastic layer 100B is smaller than the thickness of the strip 100C in the central portion in the width direction before winding). If the tension is excessively high, the degree of elastic deformation is increased and the elastic layer 100B may be deformed after storage. This phenomenon is particularly frequent after storage in a high-temperature, high-humidity environment, e.g., a temperature of 40° C. and a humidity of 95% RH.

According to the cleaning member 100 of the exemplary embodiment, the elastic layer 100B satisfies conditional formula (A1) above, in other words, the degree of elastic deformation (change in thickness in the central portion in the width direction) is minimized with respect to the strip 100C before winding. This presumably suppresses deformation of the elastic layer 100B after storage.

According to a charging device (unit for forming an image), process cartridge, and image-forming apparatus that includes the cleaning member 100 of the exemplary embodiment, image defects (such as banding) caused by the deformation of the elastic layer after storage is suppressed.

The elastic layer 100B may satisfy conditional formula (A2) and preferably satisfy conditional formula (A3) below:

$$0.8<t/T<0.95 \qquad \text{Conditional formula (A2)}$$

$$0.8<t/T<0.9 \qquad \text{Conditional formula (A3)}$$

The thickness of the elastic layer 100B in the central portion in the helical width direction is measured as follows, for example.

The cleaning member is scanned with a laser analyzer (Laser Scan Micrometer, model LSM 6200 produced by Mitsutoyo Corporation) in a longitudinal direction (axis direction) of the cleaning member at a traverse speed of 1 mm/s while having the circumferential direction of the cleaning member fixed so as to determine the profile of the elastic layer thickness. Subsequently, the same measurement is conducted by shifting the position of the scanning in the circumferential direction (measurement is conducted at three positions 120° apart from each other). The thickness of the elastic layer 100B in the central portion in the helical width direction is calculated on the basis of this profile.

The thickness T of the strip 100C in the central portion in the width direction before winding may be measured in the same manner by using a laser analyzer (Laser Scan Micrometer, model LSM 6200 produced by Mitsutoyo Corporation) by attaching the strip 100C to a zero curvature plate or the like.

Examples of the technique for rendering the elastic layer 100B to satisfy the conditional formula described above in preparing the elastic layer 100B by winding a strip 100C around a core include techniques of adjusting the thickness of a strip, the angle at which the strip is wound, and the tension at which the strip is wound.

The elastic layer 100B is helically disposed. In particular, the helical angle is 10° to 65° or about 10° to about 65° and preferably 20° to 50°. The helical width R1 is 2 mm to 18 mm or about 2 mm to about 18 mm and preferably 3 mm to 10 mm. The helical pitch R2 is 3 mm to 25 mm and preferably 15 mm to 22 mm.

In forming the elastic layer 100B by winding the strip 100C around the core 100A, the helical angle and the helical width may be adjusted as above to render it easier for the elastic layer 100B to satisfy the conditional formula described above.

The coverage by the elastic layer 100B determined by (helical width R1 of elastic layer 100B/[helical width R1 of elastic layer 100B+helical pitch R2 of elastic layer 100B (R1+R2)])×100 is 20% to 70% and preferably 25% to 55%.

When the coverage is beyond this range, the length of time the elastic layer 100B comes into contact with the member to be cleaned is increased and deposits on the surface of the cleaning member tend to re-contaminate the member to be cleaned. In contrast, when the coverage is below this range, the thickness of the elastic layer 100B is not readily stabilized and the cleaning performance may be degraded.

The helical angle θ is the angle (acute angle) between the longitudinal direction P (helical direction) of the elastic layer 100B and the axis direction Q (core axis direction) of the cleaning member 100.

The helical width R1 is the length of the elastic layer 100B in the axis direction Q (core axis direction) of the cleaning member 100.

The helical pitch R2 is the length between adjacent parts of the elastic layer 100B in the axis direction Q (core axis direction) of the cleaning member 100.

The elastic layer 100B refers to a layer composed of a material that returns to its original shape after being deformed by application of external force of 100 Pa.

The individual components will be described.

The core is described first.

Examples of the material for the core 100A include metals (e.g., free-cutting steel, stainless steel, etc.) and resins (e.g., polyacetal (POM) resin, etc.). The material and the surface treatment method may be selected according to need.

When the core 100A is composed of a metal, the core 100A is preferably plated. When the core 100A is composed of a material having no electrical conductivity, such as a resin, the material may be processed by a typical treatment such as plating to impart electrical conductivity or may be directly used as is.

The elastic layer is described next.

Examples of the material for the elastic layer 100B include foaming resins such as polyurethane, polyethylene, polyamide, and polypropylene and rubber materials such as silicone rubber, fluorine rubber, urethane rubber, ethylene propylene diene rubber (EPDM), nitrile butadiene rubber (NBR), chloroprene rubber (CR), chlorinated polyisoprene, isoprene, acrylonitrile-butadiene rubber, styrene-butadiene rubber, hydrogenated polybutadiene, and butyl rubber, and any blends of two or more of these materials. Assistant agents such as such as a foaming aid, a foam stabilizer, a catalyst, a curing agent, a plasticizer, or a vulcanization accelerator may be added to these materials.

The material for the elastic layer 100B may be a material having air bubbles, in other words, a foamed material. In particular, polyurethane foam highly resistant to stretching may be used in order not to scratch the surface of the member to be cleaned and in order to prevent shredding and breaking over a long term.

Examples of the polyurethane include reaction products between a polyol (e.g., polyester polyol, polyether polyester, or acryl polyol) and an isocyanate (such as 2,4-tolylene diisocyanate, 2,6-tolylene diisocyanate, 4,4-diphenylmethane diisocyanate, tolidine diisocyanate, or 1,6-hexamethylene diisocyanate). The polyurethane may contain a chain extender such as 1,4-butanediol or trimethylol propane. Foaming of polyurethane is typically conducted by using a foaming agent such as water or an azo compound (e.g., azodicarbonamide, azobisisobutyronitrile, etc.). An assistant agent such as a foaming aid, a foam stabilizer, or a catalyst may be added to the polyurethane foam if needed.

An ether-based polyurethane foam is particularly preferred. This is because an ester-based polyurethane foam has a tendency to deteriorate under humidity and heat. A silicone oil foam stabilizer is typically used for the ether-based polyurethane. However, image defects caused by migration of silicone oil to the member to be cleaned (e.g., charging roller) may occur during storage (in particular, long-term storage at high temperature and high humidity). Accordingly, a foam stabilizer other than silicone oil is used to prevent image defects caused by the elastic layer 100B.

Examples of the foam stabilizer other than silicone oil include Si-free organic surfactants (e.g., anionic surfactants such as dodecylbenzenesulfonic acid and sodium lauryl sulfate). A method disclosed in Japanese Unexamined Patent Application Publication No. 2005-301000 that does not use a silicone foam stabilizer may also be employed.

The elastic layer 100B may have a single layer structure or a multilayer structure. In particular, the elastic layer 100B may be constituted by a single layer of a foam body or may take a two-layer structure including a solid layer and a foam layer.

Next, a method for manufacturing the cleaning member 100 according to the exemplary embodiment is described.

Figure 4A:
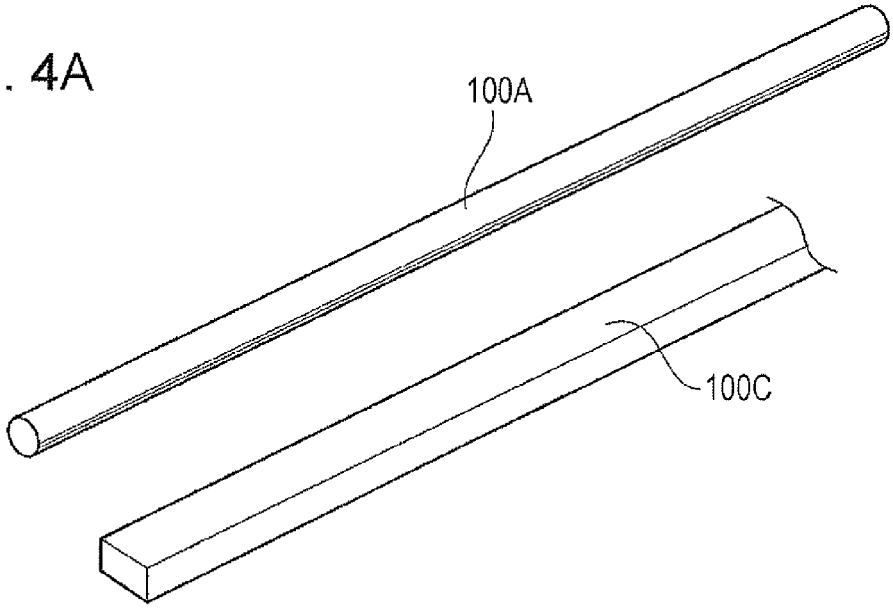
FIGS. 4A to 4C are diagrams showing examples of steps of a method for manufacturing the cleaning member for an image forming apparatus according to the exemplary embodiment.
Figure 4B:
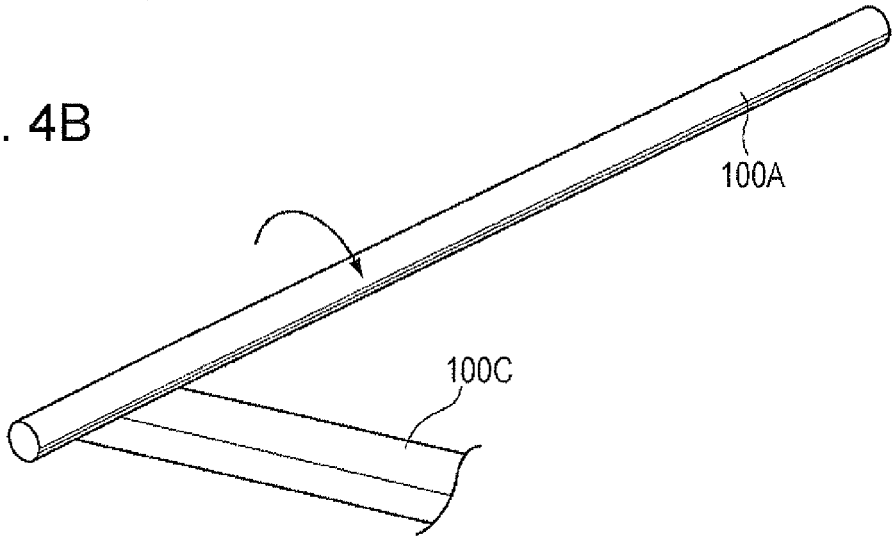
Figure 4C:
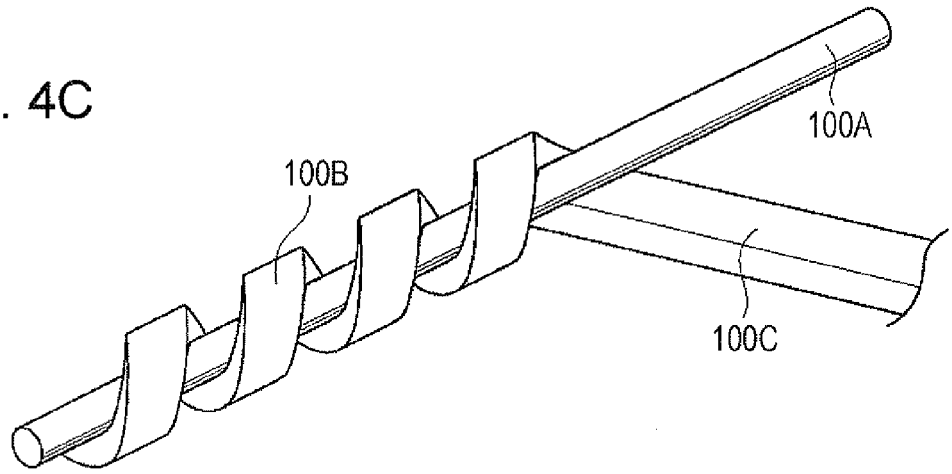

FIGS. 4A to 4C are diagrams showing examples of steps of a method for manufacturing the cleaning member 100 according to the exemplary embodiment.

Referring to FIG. 4A, a sheet-shaped elastic layer component (polyurethane foam sheet or the like) being sliced to a target thickness is prepared. A double-sided adhesive tape (not shown) is attached on one surface of the sheet-shaped elastic layer component. The elastic layer component is blanked out using a punching die to obtain a strip 100C (strip with a double-sided adhesive tape) having desired width and length. Meanwhile, the core 100A is prepared.

Next, as shown in FIG. 4B, the strip 100C is placed with the surface on which the double-sided adhesive tape is attached facing upward. One end of the releasing paper of the double-sided adhesive tape is detached and one end of the core 100A is placed on the portion of the double-sided adhesive tape from which the releasing paper is detached.

Then, as shown in FIG. 4C, while detaching the releasing paper of the double-sided adhesive tape, the core 100A is rotated at a target speed to helically wind the strip 100C around the peripheral surface of the core 100A to obtain a cleaning member 100 including a core 100A and a elastic layer 100B helically arranged on the peripheral surface of the core 100A.

In winding the strip 100C around the core 100A to form the elastic layer 100B, the position of the strip 100C may be adjusted so that the angle (helical angle) formed between the longitudinal direction of the strip 100C and the axial direction of the core 100A is a desired angle. The outer diameter of the core 100A is, for example, about 3 mm to 6 mm.

The tension applied during winding the strip 100C around the core 100A may be at a level that does not create a gap between the core 100A and the double-sided adhesive tape of the strip 100C. If excessive tension is applied, conditional formula (A1) is not easily satisfied. Moreover, the tension set is increased and the elastic force of the elastic layer 100B tends to be lowered. In particular, the tension may be at a level that the length of the strip 100C is stretched more than 0% but not more than 5% from the original length of the strip 100C.

If the strip 100C is wound around the core 100A, the strip 100C tends to be elongated. The elongation differs in the thickness direction of the strip 100C. The outermost portion tends to show the largest elongation, which results in a decrease in elastic force. The elongation of the outermost portion after the strip 100C is wound around the core 100A is preferably about 5% with respect to the outermost portion of the original strip 100C.

The elongation is controlled by the thickness of the strip 100C and the radius of curvature at which the strip 100C is wound around the core 100A. The curvature at which the strip 100C is wound around the core 100A is controlled by the outer diameter of the core 100A and the winding angle of the strip 100C.

The curvature at which the strip 100C is wound around the core 100A is, for example, ((core outer diameter/2)+0.2 mm) or more and ((core outer diameter/2)+8.5 mm) or less and preferably ((core outer diameter/2)+0.5 mm) or more and ((core outer diameter/2)+7.0 mm) or less.

The thickness of the strip 100C is, for example, about 1.5 to about 4 mm and preferably 1.5 to 3.0 mm. The width of the strip 100C may be adjusted so that the coverage of the elastic layer 100B is within the above-described range. The length of the strip 100C is determined by, for example, the length (length in the axis direction) of the region on which the strip 100C is wound around the core 100A, the winding angle, and the tension applied during winding.

(Image-Forming Apparatus Etc.)

An image forming apparatus according to an exemplary embodiment of the present invention will be described with reference to the drawings.

Figure 5:
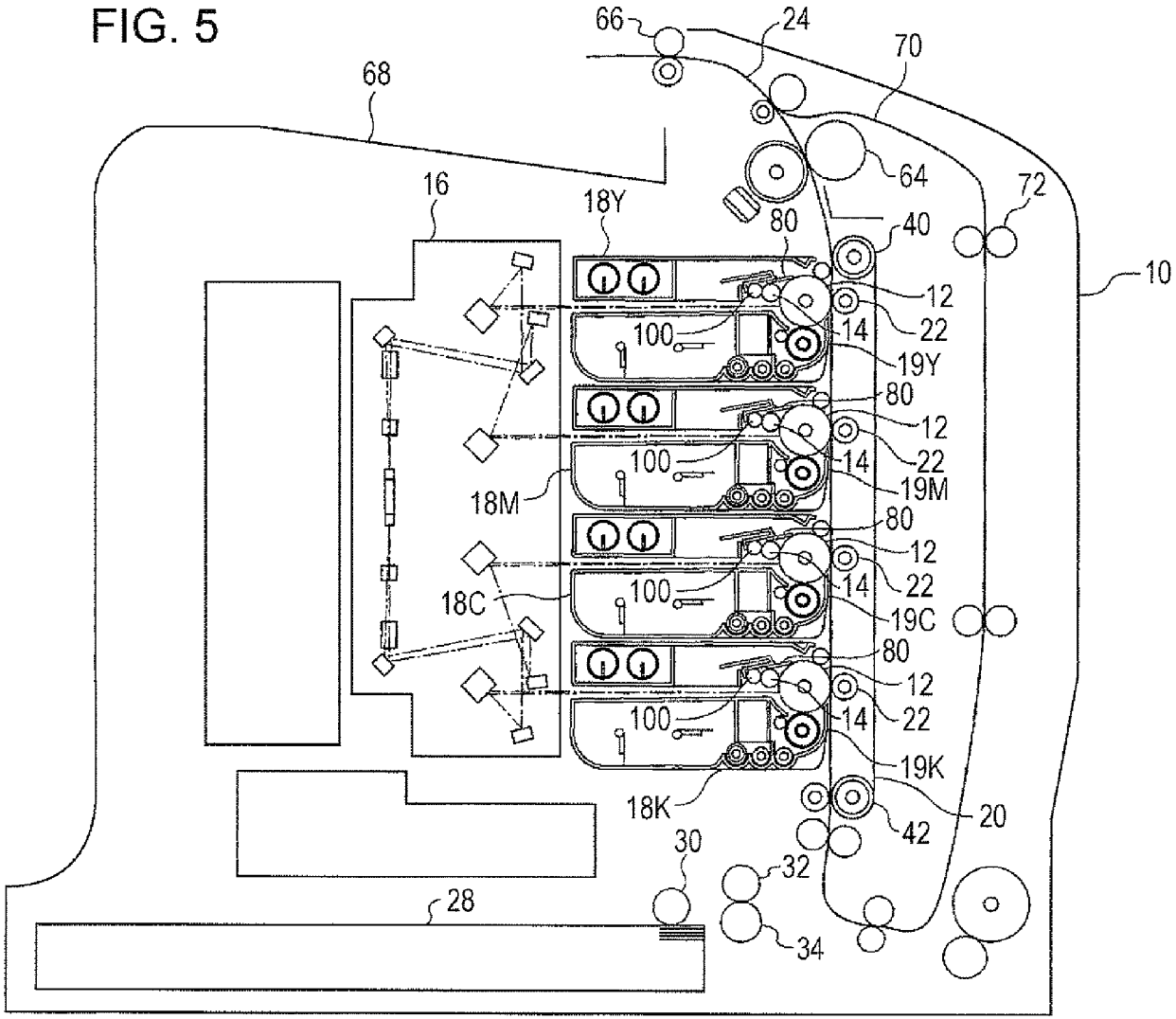
FIG. 5 is a schematic diagram showing an electrophotographic image forming apparatus according to an exemplary embodiment.

FIG. 5 is a schematic diagram showing an image forming apparatus according to an exemplary embodiment.

Figure 6:
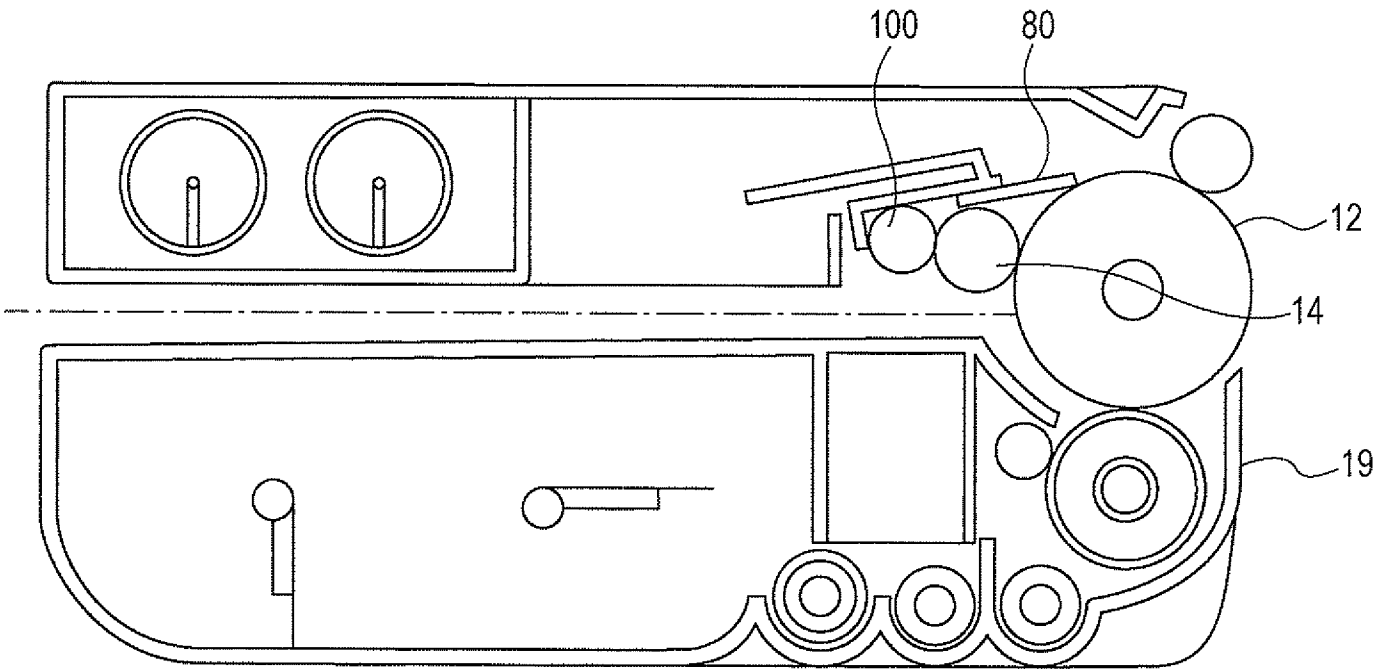
FIG. 6 is a schematic diagram showing a process cartridge according to an exemplary embodiment of the invention.

An image forming apparatus 10 according to the exemplary embodiment is a tandem system color image forming apparatus shown in FIG. 5, for example. Process cartridges (also refer to FIG. 6) each including a photoconductor (image-carrying member) 12, a charging member 14, a developing device, and other associated components are disposed inside the image forming apparatus 10. In this exemplary embodiment, four process cartridges 18Y, 18M, 18C, and 18K are respectively provided for four colors, i.e., yellow, magenta, cyan, and black. The process cartridges are detachably mounted to the image forming apparatus 10.

The photoconductor 12 is, for example, a conductive cylindrical body having a diameter of 25 mm and coated with a photoconductor layer composed of an organic photosensitive material formed on the surface, and is rotated at a process speed of 150 mm/sec by a motor not shown in the drawing.

The surface of the photoconductor 12 is charged with the charging member 14 disposed on the surface of the photoconductor 12 and irradiated with a laser beam LB emitted from an exposure device 16 so as to form an electrostatic latent image, which corresponds to image information, on the downstream side of the charging member 14 in the rotation direction of the photoconductor 12.

Electrostatic latent images formed on the photoconductors 12 are respectively developed with developing devices 19Y, 19M, 19C, and 19K for yellow (Y), magenta (M), cyan (C), and black (K) to form toner images of the four colors.

For example, when a color image is to be formed, the process of charging, exposing, and developing is conducted on the surface of each of the photoconductors 12 corresponding to yellow (Y), magenta (M), cyan (C), and black (K) so as to form a yellow toner image, a magenta toner image, a cyan toner image, and a black toner image on the photoconductors 12, respectively.

The yellow (Y), magenta (M), cyan (C), and black (K) toner images sequentially formed on the photoconductors 12 are transferred onto a recording sheet 24 at positions where the photoconductors 12 contact the transfer devices 22 while the recording sheet 24 is transported on an outer peripheral surface of a sheet transport belt 20 given tension by and supported by supporting rolls 40 and 42 from the inner peripheral side. The recording sheet 24 that has received the toner images from the photoconductors 12 is transported to a fixing device 64 and heated and pressurized by the fixing device 64 to fix the toner images on the recording sheet 24. The recording sheet 24 with toner images fixed thereon is ejected with a discharging roll 66 onto a discharge unit 68 in the upper part of the image forming apparatus 10 when the printing is to be performed on only one side of the sheet.

The recording sheet 24 is supplied from a sheet container 28 by using a supply roller 30 and transported with feed rolls 32 and 34 to the sheet transport belt 20.

In the case where double-sided printing is to be conducted, the recording sheet 24 with toner images fixed on a first surface (front surface) by the fixing device 64 is not ejected onto the ejecting unit 68 by the discharging roll 66. Instead, the discharging roll 66 holding the rear end of the recording sheet 24 is reversed while the transport path of the recording sheet 24 is switched to a sheet transport path 70 for double-sided printing. The recording sheet 24 with its side reversed is transported again onto the sheet transport belt 20 by using a feed roll 72 installed on the sheet transport path 70 so as to transfer toner images onto a second surface (rear surface) of the recording sheet 24 from the photoconductors 12. The toner images on the second surface (rear surface) of the recording sheet 24 are fixed with the fixing device 64 and the recording sheet (receiving member) is ejected onto the ejecting unit 68.

The surface of the photoconductor 12 after the toner image transfer step is cleaned with a cleaning blade 80 disposed downstream of the position that has come into contact with the transfer device 22 in the rotation direction of the photoconductor 12. This cleaning is conducted every time the photoconductor 12 is rotated to remove residual toner, paper dust, etc., and to prepare for the next image formation.

Figure 7:
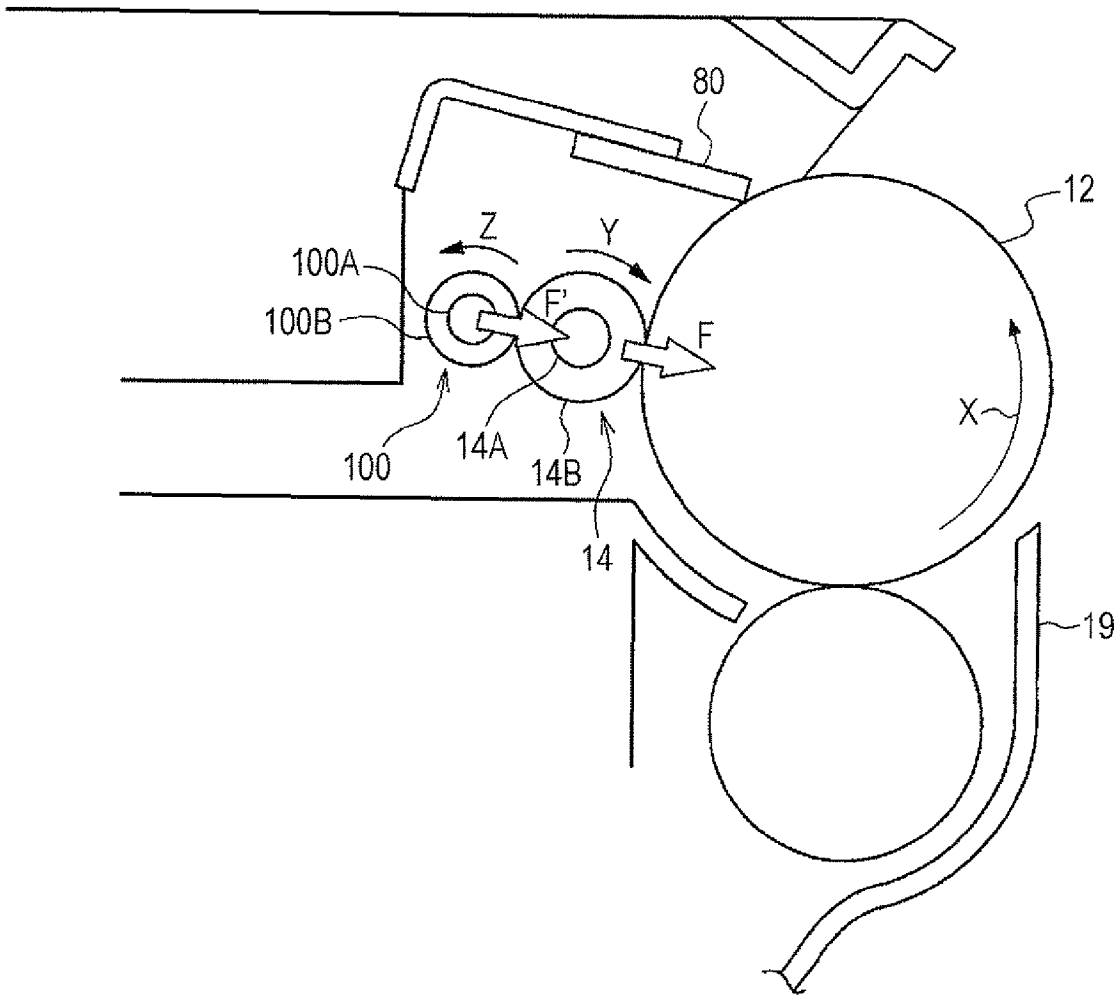
FIG. 7 is an enlarged schematic diagram showing a vicinity of a charging member (charging device) shown in FIGS. 5 and 6.

As shown in FIG. 7, the charging member 14 is, for example, a roll including a rotatably supported conductive core 14A and an elastic layer 14B surrounding the core 14A. A cleaning member 100 for cleaning the charging member 14 is in contact with a side of the charging member 14 remote from the photoconductor 12. The cleaning member 100 is part of a charging unit. The cleaning member 100 of the exemplary embodiment is used as the cleaning member.

The description below concerns the case in which the cleaning member 100 is always in contact with the charging member 14 and driven by the charging member 14. Alternatively, the charging member may be brought into contact with and driven by the charging member only during cleaning. Yet alternatively, the cleaning member 100 may be brought into contact with the charging member 14 only during cleaning and driven separately so as to have a peripheral speed different from that of the charging member 14. However, having the cleaning member 100 always in contact with the charging member 14 and creating a difference in peripheral speed may be avoided since contamination on the charging member 14 accumulates on the cleaning member 100 and may re-deposit on the charging roll.

The charging member 14 is pressed against the photoconductor 12 by application of a load F to both ends of the core 14A so that a nip portion is formed along the peripheral surface of the elastic layer 14B by elastic deformation. The cleaning member 100 is pressed against the charging member 14 by application of a load F' to both ends of the core 100A so that a nip portion is formed along the peripheral surface of the charging member 14 by elastic deformation of the elastic layer 100B. As a result, a nip portion is formed in the axis direction of the charging member 14 and the photoconductor 12 while suppressing the deflection of the charging member 14.

The photoconductor 12 is rotated in the arrow X direction by a motor not shown in the drawing and the charging member 14 is driven in the arrow Y direction by the rotation of the photoconductor 12. The cleaning member 100 is driven by the rotation of the charging member 14 and rotates in the arrow Z direction.

—Structure of Charging Member—

The description of the charging member is given below but the structure of the charging member is not limited by the description.

The structure of the charging member is not particularly limited. For example, the charging member may include a core and an elastic layer or a resin layer instead of the elastic layer. The elastic layer may have a single-layer structure or a multilayer structure including two or more layers having various functions. The elastic layer may be surface-treated.

The material of the core may be free-cutting steel or stainless steel. The material and the surface treatment method may be adequately selected according to the property such as slidability. The core may be plated. When a material having no electrical conductivity is used, the material may be processed by a typical treatment such as plating to impart electrical conductivity or may be directly used as is.

The elastic layer is a conductive elastic layer. For example, the conductive elastic layer may contain, an elastic material such as rubber, a conductive material such as carbon black and an ion conductive material for adjusting the resistance of the conductive elastic layer, and any additives commonly used as needed, such as a softener, a plasticizer, a curing agent, a vulcanizing agent, a vulcanization accelerator, an antioxidant, and a filler such as silica or calcium carbonate. The elastic layer is formed by coating the peripheral surface of the conductive core with a mixture of these materials. Examples of the conductive agent for adjusting the resistance include carbon black blended with a matrix material and a dispersion of a conductive material that uses at least one of electrons and ions as charge carriers, such as an ion conductive material. The elastic material may be foamed.

The elastic material constituting the conductive elastic layer is formed by dispersing a conductive agent in a rubber material. Examples of the rubber material include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and blend rubber of these. These rubber materials may be foamed or unfoamed.

Examples of the conductive agent include electronic conductive agents and ion conductive agents. Examples of the electronic conductive agents include fine particles composed of carbon black such as Ketjenblack and acetylene black; pyrocarbon and graphite; various conductive metals such as aluminum, copper, nickel, and stainless steel and alloys thereof; conductive metal oxides such as tin oxide, indium oxide, titanium oxide, tin oxide-antimony oxide solid solution, and tin oxide-indium oxide solid solution; and insulating materials having surfaces treated to exhibit conductivity. Examples of the ion conductive agent include perchloric acid salts and chlorates such as tetraethylammonium and lauryltrimethylammonium; and perchloric acid salts and chlorates of alkali metals and alkaline earth metals such as lithium and magnesium.

These conductive agents may be used alone or in combination of two or more. The amounts of these conductive agents added are not particularly limited. The amount of the electronic conductive agent may be 1 to 60 parts by mass relative to 100 parts by mass of rubber material. The amount of the ion conductive agent may be 0.1 to 5.0 parts by mass relative to 100 parts by mass of rubber material.

A surface layer may be formed in the surface of the charging member. The material for the surface layer may be resin, rubber, or any other suitable material and is thus not particularly limited. Examples of the material for the surface layer include polyvinylidene fluoride, ethylene tetrafluoride copolymers, polyester, polyimide, and copolymer nylon.

Examples of the copolymer nylon include those that contain at least one of nylon 6,10, nylon 11, and nylon 12 as a polymerization unit. Examples of other polymerization unit contained in the copolymer include nylon 6 and nylon 6,6. The ratio of a polymerization unit constituted by nylon 6,10, nylon 11, and/or nylon 12 in the copolymer may be 10% by mass or more in total.

The polymer materials may be used alone or in combination of two or more. The number-average molecular weight of the polymer material is preferably 1,000 to 100,000 and more preferably 10,000 to 50,000.

A conductive material may be added to the surface layer to control the resistance. A conductive material may have a particle size of 3 μm or less.

Examples of the conductive agent for adjusting the resistance include carbon black and conductive metal oxide particles blended with a matrix material, and a dispersion of a conductive material that uses at least one of electrons and ions as charge carriers, such as an ion conductive material.

Examples of carbon black used as a conductive agent include Special Black 350, Special Black 100, Special Black 250, Special Black 5, Special Black 4, Special Black 4A, Special Black 550, Special Black 6, Color Black FW200, Color Black FW2, and Color Black FW2V produced by Degussa, and MONARCH 1000, MONARCH 1300, MONARCH 1400, MOGUL-L, and REGAL 400R produced by CABOT CORPORATION.

Carbon black may have a pH of 4.0 or less.

The conductive metal oxide particles used as conductive particles for adjusting resistance is not particularly limited and may be any conductive particles that use electrons as charge carriers. Examples thereof include tin oxide, antimony-doped tin oxide, zinc oxide, anatase-type titanium oxide, and indium tin oxide (ITO). These may be used alone or in combination of two or more. The particle size may be any. The conductive particles are preferably tin oxide, antimony-doped tin oxide, or anatase-type titanium oxide and more preferably tin oxide or antimony-doped tin oxide.

The surface layer may be composed of a fluorine-based or silicone-based resin. In particular, the surface layer may be composed of a fluorine-modified acrylate polymer. Particles may be added to the surface layer. Insulating particles such as alumina or silica may be added to impart irregularities on the surface of the charging member so that the frictional load imposed during contact with the photoconductor is decreased and the wear resistance between the charging member and the photoconductor is improved.

The outer diameter of the charging member may be 8 mm to 16 mm. The outer diameter is measured with a commercially available caliper or a laser-system outer diameter measuring device.

The microhardness of the charging member may be 45° to 60°. In order to decrease hardness, the amount of plasticizer added may be increased or a low-hardness material such as silicone rubber may be used.

The microhardness of the charging member is the value determined with MD-1 durometer produced by Kobunshi Keiki Co., Ltd.

The image forming apparatus of the exemplary embodiment includes a photoconductor (image-carrying member), a charging device (unit constituted by a charging member and a cleaning member), a developing device, and a cleaning blade (cleaning device) but the image forming apparatus is not limited to this. For example, a charging device (unit constituted by a charging member and a cleaning member) and, if needed, at least one selected from a photoconductor (image-carrying member), an exposing device, a transfer device, a developing device, and a cleaning blade (cleaning device) may be combined to form a process cartridge. It should be noted that these devices and members need not be formed into a cartridge and may be directly installed in the image forming apparatus.

The image forming apparatus of the exemplary embodiment described above includes a charging device which is a unit constituted by a charging member and a cleaning member, in other words, a structure in which the charging member is the member to be cleaned. However, the structure is not limited to this. The member to be cleaning may be a photoconductor (image-carrying member), a transfer device (transfer member or transfer roll), and/or an intermediate transfer body (intermediate transfer belt). The unit constituted by the member to be cleaned and the cleaning member in contact with the member to be cleaned may be installed directly on the image forming apparatus or may be formed into a cartridge as with the process cartridge described above and installed in the image forming apparatus.

The image forming apparatus of the exemplary embodiment is not limited to one having the above-described structure. Image forming apparatuses of an intermediate transfer type and other known types may be employed.

EXAMPLES

The present invention will be described by using Examples below which do not limit the present invention.

Example 1

(Preparation of Cleaning Roll 1)

A double-sided adhesive tape 0.15 mm in thickness is attached to urethane foam (EPM-70, product of INOAC CORPORATION) 3.25 mm in thickness and a strip 3.4 mm in thickness (in the central portion in the width direction), 6 mm in width, and 356 mm in length is cut out. The strip is wound around a stepped metal core (outer diameter: 6 mm, length: 337 mm, outer diameter and length of bearing portion: 4 mm and 6.0 mm) at a winding angle of 40° so that the sheet length is stretched by 0% to 5% to form a helically arranged elastic layer and a cleaning roll 1.

(Preparation of Charging Roll)

—Formation of Elastic Layer—

A mixture described below is kneaded with an open roll, applied on a surface of a conductive support composed of SUS 416 stainless steel 6 mm in diameter so as to form a cylindrical body having a thickness of 3 mm, placed in a cylindrical die having an inner diameter of 18.0 mm, vulcanized for 30 minutes at 170° C., released from the die, and polished to obtain a cylindrical conductive elastic layer A.

Rubber material: 100 parts by mass (epichlorohydrin-ethylene oxide-allyl glycidyl ether copolymer rubber) Gechron 3106: product of ZEON CORPORATION Conductive agent (carbon black Asahi Thermal, product of ASAHI CARBON CO., LTD.) 25 parts by mass Conductive agent (Ketjenblack EC: product of Lion Corporation) 8 parts by mass Ion conductive agent (lithium perchlorate) 1 part by mass Vulcanizing agent (sulfur) 200 mesh: product of Tsurumi Chemical Co.) 1 part by mass Vulcanization accelerator (Nocceler DM: product of OUCHI SHINKO CHEMICAL INDUSTRIAL CO., LTD) 2.0 parts by mass Vulcanization accelerator (Nocceler TT: product of OUCHI SHINKO CHEMICAL INDUSTRIAL CO., LTD) 0.5 parts by mass —Formation of Surface Layer—

A dispersion obtained by dispersing the mixture below with a bead mill is diluted with methanol, applied on a surface of the conductive elastic layer A by dip-coating, and thermally dried at 140° C. for 15 minutes to form a surface layer having a thickness of 4 μm to obtain a conductive roll. This conductive roll is used as a charging roll.

Polymer material 100 parts by weight (copolymer nylon) Amilan CM8000: product of Toray Industries. Inc.

Conductive agent: 30 parts by mass (antimony-doped tin oxide) SN-100P: product of ISHIHARA SANGYO KAISHA LTD.

Solvent (methanol) 500 parts by mass

Solvent (butanol) 240 parts by mass

Example 2

(Preparation of Cleaning Roll 2)

A helically arranged elastic layer and a cleaning roll 2 are prepared as in Example 1 except that the thickness of the polyurethane foam sheet is 2.85 mm and a strip having a thickness (thickness in the central portion in the width direction) of 3 mm is used.

Preparation of Charging Roll

A charging roll is prepared as in Example 1.

Example 3

(Preparation of Cleaning Roll 3)

A helically arranged elastic layer and a cleaning roll 3 are prepared as in Example 1 except that the thickness of the polyurethane foam sheet is 2.6 mm and a strip having a thickness (thickness in the central portion in the width direction) of 2.75 mm is used.

(Preparation of Charging Roll)

A charging roll is prepared as in Example 1.

Example 4

(Preparation of Cleaning Roll 4)

A helically arranged elastic layer and a cleaning roll 4 are prepared as in Example 1 except that the thickness of the polyurethane foam sheet is 2.05 mm and a strip having a thickness (thickness in the central portion in the width direction) of 2.2 mm is used.

Preparation of Charging Roll

A charging roll is prepared as in Example 1.

Example 5

(Preparation of Cleaning Roll 5)

A helically arranged elastic layer and a cleaning roll 5 are prepared as in Example 1 except that the thickness of the polyurethane foam sheet is 1.65 mm and a strip having a thickness (thickness in the central portion in the width direction) of 1.8 mm is used.

(Preparation of Charging Roll)

A charging roll is prepared as in Example 1.

Example 6

(Preparation of Cleaning Roll 6)

A helically arranged elastic layer and a cleaning roll 6 are prepared as in Example 1 except that the thickness of the polyurethane foam sheet is 1.6 mm and a strip having a thickness (thickness in the central portion in the width direction) of 1.75 mm is used.

(Preparation of Charging Roll)

A charging roll is prepared as in Example 1.

Examples 7 to 12

(Preparation of Cleaning Rolls 7 to 12)

Cleaning rolls 7 to 12 are prepared as in Examples 1 to 6 except that the core is a cylindrical core having an outer diameter of 4 mm and a length of 337 mm and the helical angle is set to 26°.

(Preparation of Charging Roll)

A charging roll is prepared as in Example 1.

Example 13

(Preparation of Cleaning Roll 13)

A cleaning roll 13 is prepared as in Example 1 except that the helical angle is 65°, the thickness of the polyurethane foam sheet is 1.85 mm, and a strip having a thickness (thickness in the central portion in the width direction) of 2.0 mm is used.

(Preparation of Charging Roll)

A charging roll is prepared as in Example 1.

Example 14

(Preparation of Cleaning Roll 14)

A cleaning roll 14 is prepared as in Example 1 except that the core is a cylindrical core having an outer diameter of 4 mm and a length of 337 mm, the helical angle is 10°, the thickness of the polyurethane foam sheet is 2.85 mm, and a strip having a thickness (thickness in the central portion in the width direction) of 3.0 mm is used.

(Preparation of Charging Roll)

A charging roll is prepared as in Example 1.

Comparative Example 1

(Preparation of Cleaning Roll 15)

A helically arranged elastic layer and a cleaning roll 15 are prepared as in Example 1 except that the thickness of the polyurethane foam sheet is 3.35 mm and a strip having a thickness (thickness in the central portion in the width direction) of 3.5 mm is used.

(Preparation of Charging Roll)

A charging roll is prepared as in Example 1.

Comparative Example 2

(Preparation of Cleaning Roll 16)

A helically arranged elastic layer and a cleaning roll 16 are prepared as in Example 1 except that the thickness of the polyurethane foam sheet is 1.45 mm and a strip having a thickness (thickness in the central portion in the width direction) of 1.6 mm is used.

(Preparation of Charging Roll)

A charging roll is prepared as in Example 1.

Comparative Example 3

(Preparation of Cleaning Roll 17)

A cleaning roll 17 is prepared as in Example 7 except that the thickness of the polyurethane foam sheet is 3.35 mm, and a strip having a thickness (thickness in the central portion in the width direction) of 3.5 mm is used.

(Preparation of Charging Roll)

A charging roll is prepared as in Example 1.

Comparative Example 4

(Preparation of Cleaning Roll 18)

A cleaning roll 18 is prepared as in Example 7 except that the thickness of the polyurethane foam sheet is 1 45 mm, and a strip having a thickness (thickness in the central portion in the width direction) of 1.6 mm is used.

(Preparation of Charging Roll)

A charging roll is prepared as in Example 1.

Comparative Example 5

(Preparation of Cleaning Roll 19)

A cleaning roll 19 is prepared as in Example 1 except that the helical angle is 70°, the thickness of the urethane sheet foam is 1.85 mm, and a strip having a thickness (thickness in the central portion in the width direction) of 2.0 mm is used.

(Preparation of Charging Roll)

A charging roll is prepared as in Example 1.

Comparative Example 6

(Preparation of Cleaning Roll 20)

A cleaning roll 20 is prepared as in Example 7 except that the helical angle is 5°, the thickness of the urethane sheet foam is 2.85 mm, and a strip having a thickness (thickness in the central portion in the width direction) of 3.0 mm is used.

(Preparation of Charging Roll)

A charging roll is prepared as in Example 1.

[Evaluation]

(Evaluation of Property)

The thickness (thickness in the helical width direction) of the elastic layer of the cleaning rolls prepared in the examples is investigated. The results are shown in Table 1.

(Storage Evaluation)

A cleaning roll and a charging roll of each example are installed in a color copier DocuCentre-III C3300 produced by Fuji Xerox Co., Ltd., modified so that the charging power source is a DC power source only. The installation is performed after the process cartridge of the color copier including the cleaning roll and the charging roll preliminarily installed therein is stored at a temperature of 40° C. and 95% RH for one month.

Half-tone images are output from the color copier and the extent of banding (image defects immediately after storage) is evaluated.

(Evaluation of Cleaning Property and Color Spots)

The cleaning roll and the charging roll of each example are installed in a color copier DocuCentre-III C3300 produced by Fuji Xerox Co., Ltd., modified so that the charging power source is a DC power source only. Printing is conducted on 300,000 A4 sheets. Half-tone images are then output. Whether banding (cleaning property) caused by non-uniform cleaning of the charging roll occurs and whether there are color spots caused by cleaning roll segments are evaluated on the basis of the following standards. The results are shown in Table 1.

Evaluation Standard of Image Defects Immediately after Storage

AA: No banding occurs in the image and the cleaning roll does not undergo deformation.

A: No banding occurs in the image but slight deformation occurs in the cleaning roll.

B: Slight banding occurs in the image.

C: Banding occurs in the image.

Evaluation Standard of Cleaning Property

AA: No banding occurs in the image and the cleaning roll does not undergo deformation.

A: No banding occurs in the image but slight deformation occurs in the cleaning roll.

B: Slight banding occurs in the image.

C: Banding occurs in the image.

Evaluation Standard for Color Spots

A: Color spots are not found in the image.

C: Color spots are found in the image.

TABLE 1

| | Core outer diameter (mm) | Helical angle (°) | Elastic layer thickness in helical width direction | Thickness of strip in a central portion in the width direction before winding | t/T | Image defect immediately after storage | Cleaning property | Color spot |
|---|---|---|---|---|---|---|---|---|
| Example 1 | 6 | 40 | 2.4 | 3.4 | 0.71 | B | A | A |
| Example 2 | 6 | 40 | 2.35 | 3 | 0.78 | A | A | A |
| Example 3 | 6 | 40 | 2.2 | 2.75 | 0.80 | AA | A | A |
| Example 4 | 6 | 40 | 1.87 | 2.2 | 0.85 | AA | A | A |
| Example 5 | 6 | 40 | 1.62 | 1.8 | 0.90 | AA | A | A |
| Example 6 | 6 | 40 | 1.6 | 1.75 | 0.91 | B | A | A |
| Example 7 | 4 | 26 | 2.4 | 3.4 | 0.71 | B | A | A |
| Example 8 | 4 | 26 | 2.35 | 3 | 0.78 | A | A | A |
| Example 9 | 4 | 26 | 2.2 | 2.75 | 0.80 | AA | A | A |
| Example 10 | 4 | 26 | 1.87 | 2.2 | 0.85 | AA | A | A |
| Example 11 | 4 | 26 | 1.62 | 1.8 | 0.90 | AA | A | A |
| Example 12 | 4 | 26 | 1.6 | 1.75 | 0.91 | B | A | A |
| Example 13 | 6 | 65 | 1.42 | 2.0 | 0.71 | A | A | A |
| Example 14 | 4 | 10 | 2.72 | 3.0 | 0.91 | A | A | A |
| Comparative | 6 | 40 | 2.45 | 3.5 | 0.70 | C | A | A |

TABLE 1-continued

| | Core outer diameter (mm) | Helical angle (°) | Elastic layer thickness in helical width direction | Thickness of strip in a central portion in the width direction before winding | t/T | Image defect immediately after storage | Cleaning property | Color spot |
|---|---|---|---|---|---|---|---|---|
| Example 1 | | | | | | | | |
| Comparative Example 2 | 6 | 40 | 1.52 | 1.6 | 0.95 | C | A | A |
| Comparative Example 3 | 4 | 26 | 2.45 | 3.5 | 0.70 | C | A | A |
| Comparative Example 4 | 4 | 26 | 1.52 | 1.6 | 0.95 | C | A | A |
| Comparative Example 5 | 6 | 70 | 1.4 | 2.0 | 0.70 | C | A | A |
| Comparative Example 6 | 4 | 5 | 2.85 | 3.0 | 0.95 | C | A | A |

The results show that, compared to Comparative Example, Examples had less image defects immediately after storage.

The results also show that the Examples exhibited higher cleaning property and less color spots caused by polishing powder and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus, comprising:

a core; and an elastic layer that is formed by a strip-shaped elastic member helically wound around an outer peripheral surface of the core, wherein the cleaning member satisfies the following formula (1):

$$0.85<t/T<1.0 \quad (1)$$

where t (mm) denotes a thickness of the elastic layer, the thickness being taken in a central portion in a helical width direction of the elastic layer, and T (mm) denotes a thickness of the central portion of the strip-shaped elastic member in a width direction before wound around the outer peripheral surface of the core.

2. The cleaning member according to claim 1, wherein the cleaning member satisfies formula (2):

$$0.85\leqq t/T<0.95 \quad (2).$$

3. The cleaning member according to claim 1, wherein a helical angle of the elastic layer is about 10° to about 65° and a helical width of the elastic layer is about 2 mm to about 18 mm,

4. A charging device comprising:

a charging member that charges a member to be charged; and the cleaning member according to claim 1 in contact with a surface of the charging member and configured to clean the surface of the charging member.

5. An image forming apparatus comprising:

an image-carrying member;

a charginging unit including the charging device according to claim 4, the charging unit configured to charge a surface of the image-carrying member;

a latent image-forming unit that forms a latent image on the charged surface of the image-carrying member;

a developing unit that develops the latent image on the surface of the image-carrying member into a visualized image; and a transfer unit that transfers the visualized image to a receiving member,

6. A unit for an image forming apparatus, the unit comprising:

a member to be cleaned; and the cleaning member according to claim 1 in contact with a surface of the member to be cleaned and configured to clean the surface of the member to be cleaned,

7. The unit according to claim 6, wherein the unit is a process cartridge that is removably attachable to an image forming apparatus.

8. A process cartridge comprising:

the charging device according to claim 4.

9. An image forming apparatus comprising;

the unit according to claim 6,

10. A cleaning member for an image forming apparatus, comprising:

a core; and an elastic layer that is formed by a strip-shaped elastic member helically wound around an outer peripheral surface of the core, wherein the cleaning member satisfies the following formula (3):

$$20\%\leqq\{R1/(R1+R2)\}\times100\leqq70\% \quad (3)$$

where R1 denotes a helical width of the elastic layer, and R2 denotes a helical pitch of the elastic layer.

11. The cleaning member according to claim 10, wherein the cleaning member satisfies formula (4):

$$25\%\leqq\{R1/(R1+R2)\}\times100\leqq55\% \quad (4).$$

* * * * *